US009142188B2

(12) United States Patent
Kurikko

(10) Patent No.: US 9,142,188 B2
(45) Date of Patent: Sep. 22, 2015

(54) METHODS AND APPARATUS FOR REDUCING FLICKERING AND MOTION BLUR IN A DISPLAY DEVICE

(75) Inventor: Jarmo Juhani Kurikko, Espoo (FI)

(73) Assignee: Nokia Technologies Oy, Espoo (FI)

( * ) Notice: Subject to any disclaimer, the term of this patent is extended or adjusted under 35 U.S.C. 154(b) by 158 days.

(21) Appl. No.: 13/637,197

(22) PCT Filed: Aug. 23, 2010

(86) PCT No.: PCT/IB2010/053791

§ 371 (c)(1),
(2), (4) Date: Feb. 27, 2013

(87) PCT Pub. No.: WO2011/117684

PCT Pub. Date: Sep. 29, 2011

(65) Prior Publication Data

US 2013/0147857 A1 Jun. 13, 2013

(30) Foreign Application Priority Data

Mar. 25, 2010 (WO) ..... PCT/IB2010/051320

(51) Int. Cl.
*G09G 5/10* (2006.01)
*G09G 3/20* (2006.01)
(Continued)

(52) U.S. Cl.
CPC .. *G09G 5/10* (2013.01); *G09G 3/20* (2013.01); *G09G 3/2081* (2013.01); *G09G 3/3406* (2013.01); *G09G 5/001* (2013.01); *G09G 2310/063* (2013.01); *G09G 2320/0261* (2013.01); *G09G 2320/0626* (2013.01); *G09G 2320/10* (2013.01); *G09G 2360/144* (2013.01); *G09G 2360/18* (2013.01)

(58) Field of Classification Search
CPC ..... G09G 3/20; G09G 3/2081; G09G 3/3406; G09G 5/10; G09G 5/001; G09G 2310/063; G09G 2320/0626; G09G 2320/0261; G09G 2320/10; G09G 2360/144; G09G 2360/18
USPC ..... 345/76, 102, 168, 172, 204–207, 345/690–692; 315/313; 398/172; 349/68; 257/159
See application file for complete search history.

(56) References Cited

U.S. PATENT DOCUMENTS 4,853,888 A * 8/1989 Lata et al. ..... 345/172
6,091,382 A * 7/2000 Shioya et al. ..... 345/76
6,509,885 B1 * 1/2003 Hanaki et al. ..... 345/76
(Continued)

FOREIGN PATENT DOCUMENTS

CN 101452681 A 10/2009
EP 1 589 518 A2 10/2005
(Continued)

OTHER PUBLICATIONS

Priority document 61266482 20110135317.*
(Continued)

*Primary Examiner* — Prabodh M Dharia
(74) *Attorney, Agent, or Firm* — Harrington & Smith

(57) ABSTRACT

A method including selecting a luminance setting for at least a portion of a display from a plurality of luminance settings; controlling the insertion of blank fields with respect to frames of data displayed on the display for the selected luminance setting at a duty ratio, at least some of the luminance settings having an associated range of duty ratios for reducing flicker and/or blur perceived by a user.

20 Claims, 5 Drawing Sheets

(51) Int. Cl.

| | |
|---|---|
| ***G09G 3/34*** | (2006.01) |
| ***G09G 5/00*** | (2006.01) |

(56) References Cited

U.S. PATENT DOCUMENTS

| | | | | |
|---|---|---|---|---|
| 7,133,015 | B1 | 11/2006 | Yoshida et al. | 345/99 |
| 7,298,358 | B2 | 11/2007 | Honbo | 345/102 |
| 7,332,742 | B2 * | 2/2008 | Miyake et al. | 257/59 |
| 2001/0008394 | A1 * | 7/2001 | Kanamori | 345/7 |
| 2004/0066373 | A1 * | 4/2004 | Wu | 345/168 |
| 2004/0160393 | A1 * | 8/2004 | Kato | 345/80 |
| 2004/0252115 | A1 | 12/2004 | Boireau | 345/211 |
| 2005/0062691 | A1 | 3/2005 | Tamura et al. | 345/76 |
| 2005/0259064 | A1 | 11/2005 | Sugino et al. | 345/102 |
| 2006/0007218 | A1 * | 1/2006 | Miyake et al. | 345/204 |
| 2006/0146005 | A1 | 7/2006 | Baba et al. | 345/102 |
| 2007/0024772 | A1 * | 2/2007 | Childers et al. | 349/68 |
| 2007/0103408 | A1 | 5/2007 | Tada et al. | 345/76 |
| 2007/0115209 | A1 | 5/2007 | Maejima | 345/46 |
| 2007/0120766 | A1 * | 5/2007 | Yanamoto | 345/38 |
| 2007/0126757 | A1 * | 6/2007 | Itoh et al. | 345/690 |
| 2008/0068359 | A1 * | 3/2008 | Yoshida et al. | 345/204 |
| 2008/0186261 | A1 | 8/2008 | Lee | 345/82 |
| 2008/0303808 | A1 | 12/2008 | Huang | 345/214 |
| 2009/0033686 | A1 * | 2/2009 | Asano | 345/690 |
| 2009/0135304 | A1 | 5/2009 | Inoue et al. | 348/712 |
| 2009/0140964 | A1 | 6/2009 | Chiang | 345/87 |
| 2010/0013995 | A1 | 1/2010 | Um | 348/500 |
| 2010/0066714 | A1 * | 3/2010 | Ozaki | 345/207 |
| 2010/0103089 | A1 * | 4/2010 | Yoshida et al. | 345/102 |
| 2010/0123416 | A1 * | 5/2010 | Lin et al. | 315/313 |
| 2010/0277409 | A1 * | 11/2010 | Yamamoto | 345/102 |
| 2010/0315408 | A1 * | 12/2010 | Kang et al. | 345/214 |
| 2011/0135317 | A1 * | 6/2011 | Chaplin | 398/172 |
| 2012/0327142 | A1 * | 12/2012 | Kimura | 345/690 |

FOREIGN PATENT DOCUMENTS

| | | | |
|---|---|---|---|
| EP | 2 141 685 | A2 | 1/2010 |
| GB | 2 455 846 | A | 6/2009 |
| JP | 2005-164937 | | 6/2005 |
| KR | 2007-0119198 | | 12/2007 |
| KR | 2008-0015598 | | 2/2008 |
| WO | WO 2006/123706 | A1 | 11/2006 |
| WO | WO 2009/125600 | | 10/2009 |
| WO | WO 2009/145329 | A1 | 12/2009 |

OTHER PUBLICATIONS

RelationBtwnLuminanceUniformityBrightnessPerception.*

Amanatides, J., et al., "Antialiasing of Interlaced Video Animation", © 1990, Computer Graphics, vol. 24, No. 4, Aug. 1990, 9 pgs.

Pan, H., et al., "Quantitative Analysis of LCD Motion Blur and Performance of Existing Approaches", © 2005 SID, 4 pgs.

* cited by examiner

METHODS AND APPARATUS FOR REDUCING FLICKERING AND MOTION BLUR IN A DISPLAY DEVICE

TECHNOLOGICAL FIELD

Embodiments of the present invention relate to methods and apparatus. In particular, they relate to methods and apparatus in a portable electronic device.

BACKGROUND

An apparatus such as a mobile cellular telephone usually includes a display for presenting information to a user. In recent years, the types of information presented via the display have increased and now typically include still content (digital photographs for example) and moving content (digital videos for example). Where the display is a touch screen display, moving content may be items moved by a user within the graphical user interface. In some instances, moving content may appear blurred to a user of the apparatus.

It would therefore be desirable to provide an alternative apparatus.

BRIEF SUMMARY

According to various, but not necessarily all, embodiments of the invention there is provided a method comprising: selecting a luminance setting for at least a portion of a display from a plurality of luminance settings; controlling the insertion of blank fields with respect to frames of data displayed on the display for the selected luminance setting at a duty ratio, at least some of the luminance settings having an associated range of duty ratios for reducing flicker and/or blur perceived by a user.

The plurality of luminance settings may be a plurality of gamma settings.

The method may further comprise changing at least some of the luminance settings in value in dependence upon one or more detected contexts.

The ranges of duty ratios may be predetermined to minimize flicker and/or blur perceived by a user.

The method may further comprise changing the range of one or more ranges of duty ratios in dependence upon one or more detected contexts to minimize flicker and/or blur perceived by a user.

The one or more detected contexts may include detected movement of content displayed on the display.

The method may further comprise selecting a duty ratio from the range of duty ratios associated with the selected luminance setting in dependence upon one or more detected contexts.

The one or more detected contexts may include detected illuminance. The one or more detected contexts may include detected movement of content displayed on the display.

The method may further comprise determining whether the display content is updated, wherein if the display content is updated the method includes entering an impulse drive mode, and if the display content is not updated the method includes entering the impulse drive mode and controlling the insertion of blank fields with respect to frames of data at a higher frequency than if display content is updated, or not entering impulse drive mode.

The method may further comprise selecting a different luminance setting, having an associated range of duty ratios, for at least a portion of the display in dependence upon one or more detected contexts.

The method may further comprise selecting a different luminance setting, having an associated range of duty ratios, for at least a portion of the display in dependence upon displayed content.

The method may further comprise performing content adaptive brightness control (C-ABC) to modify content frame image data of one or more frames of data and wherein the luminance setting and duty ratio are selected to maintain a display luminance.

The method may further comprise dynamically changing display frame rate in dependence upon the content in the frames of data to minimize perceived flicker.

The method may further comprise providing a plurality of profiles, wherein at least some of the plurality of profiles have a plurality of luminance settings and associated ranges of duty ratios.

Controlling the insertion of blank fields with respect to frames of data displayed on the display may include controlling the display to display the blank fields.

The display may be an active matrix organic light emitting diode (AM OLED) display having a predefined number of luminance settings.

Controlling the insertion of blank fields with respect to frames of data displayed on the display may include switching backlighting for the display.

The display may have a low power mode and impulse drive mode may be useable in conjunction with the low power mode.

According to various, but not necessarily all, embodiments of the invention there is provided an apparatus comprising: at least one processor; and at least one memory including computer program code; the at least one memory and the computer program code configured to, with the at least one processor, cause the apparatus at least to perform: selecting a luminance setting for at least a portion of a display from a plurality of luminance settings; controlling the insertion of blank fields with respect to frames of data displayed on the display for the selected luminance setting at a duty ratio, at least some of the luminance settings having an associated range of duty ratios for reducing flicker and/or blur perceived by a user.

The plurality of luminance settings may be a plurality of gamma settings.

The at least one memory and the computer program code may be configured to, with the at least one processor, cause the apparatus at least to perform: changing at least some of the luminance settings in value in dependence upon one or more detected contexts.

The ranges of duty ratios may be predetermined to minimize flicker and/or blur perceived by a user.

The at least one memory and the computer program code may be configured to, with the at least one processor, cause the apparatus at least to perform: changing the range of one or more ranges of duty ratios in dependence upon one or more detected contexts to minimize flicker and/or blur perceived by a user.

The one or more detected contexts may include detected movement of content displayed on the display.

The at least one memory and the computer program code may be configured to, with the at least one processor, cause the apparatus at least to perform: selecting a duty ratio from the range of duty ratios associated with the selected luminance setting in dependence upon one or more detected contexts.

The one or more detected contexts may include detected illuminance.

The one or more detected contexts may include detected movement of content displayed on the display.

The at least one memory and the computer program code may be configured to, with the at least one processor, cause the apparatus at least to perform: determining whether the display content is updated, wherein if the display content is updated the method includes entering an impulse drive mode, and if the display content is not updated the method includes entering the impulse drive mode and controlling the insertion of blank fields with respect to frames of data at a higher frequency than if display content is updated, or not using impulse drive mode.

The at least one memory and the computer program code may be configured to, with the at least one processor, cause the apparatus at least to perform: selecting a different luminance setting, having an associated range of duty ratios, for at least a portion of the display in dependence upon one or more detected contexts.

The at least one memory and the computer program code may be configured to, with the at least one processor, cause the apparatus at least to perform: selecting a different luminance setting, having an associated range of duty ratios, for at least a portion of the display in dependence upon displayed content.

The at least one memory and the computer program code may be configured to, with the at least one processor, cause the apparatus at least to perform: performing content adaptive brightness control (C-ABC) to modify content frame image data of one or more frames of data and wherein the luminance setting and duty ratio are selected to maintain a display luminance.

The at least one memory and the computer program code may be configured to, with the at least one processor, cause the apparatus at least to perform: dynamically changing display frame rate in dependence upon the content in the frames of data to minimize perceived flicker.

The at least one memory and the computer program code may be configured to, with the at least one processor, cause the apparatus at least to perform: providing a plurality of profiles, wherein at least some of the plurality of profiles have a plurality of luminance settings and associated ranges of duty ratios.

Controlling the insertion of blank fields with respect to frames of data displayed on the display may include controlling the display to display the blank fields.

The display may be an active matrix organic light emitting diode (AM OLED) display having a predefined number of luminance settings.

Controlling the insertion of blank fields with respect to frames of data displayed on the display may include switching backlighting for the display.

The display may have a low power mode and impulse drive mode may be useable in conjunction with the low power mode.

According to various, but not necessarily all, embodiments of the invention there is provided an apparatus comprising: means for selecting a luminance setting for at least a portion of a display from a plurality of luminance settings; means for controlling the insertion of blank fields with respect to frames of data displayed on the display for the selected luminance setting at a duty ratio, at least some of the luminance settings having an associated range of duty ratios for reducing flicker and/or blur perceived by a user.

According to various, but not necessarily all, embodiments of the invention there is provided a portable electronic device comprising an apparatus as described in any of the preceding paragraphs.

According to various, but not necessarily all, embodiments of the invention there is provided a module comprising an apparatus as described in any of the preceding paragraphs.

According to various, but not necessarily all, embodiments of the invention there is provided a computer readable storage medium encoded with instructions that, when executed by a processor, perform: selecting a luminance setting for at least a portion of a display from a plurality of luminance settings; controlling the insertion of blank fields with respect to frames of data displayed on the display for the selected luminance setting at a duty ratio, at least some of the luminance settings having an associated range of duty ratios for reducing flicker and/or blur perceived by a user.

The computer readable storage medium may be encoded with instructions that, when executed by a processor, perform: changing the range of one or more ranges of duty ratios in dependence upon one or more detected contexts to minimize flicker perceived by a user.

The computer readable storage medium may be encoded with instructions that, when executed by a processor, perform: selecting a duty ratio from the range of duty ratios associated with the selected luminance setting in dependence upon one or more detected contexts.

According to various, but not necessarily all, embodiments of the invention there is provided a computer program that, when run on a computer, performs the method described in any of the preceding paragraphs.

BRIEF DESCRIPTION

For a better understanding of various examples of embodiments of the present invention reference will now be made by way of example only to the accompanying drawings in which.

DETAILED DESCRIPTION

In the following description, the wording 'connect' and 'couple' and their derivatives mean operationally connected/coupled. It should be appreciated that any number or combination of intervening components can exist (including no intervening components).

Figure 1:
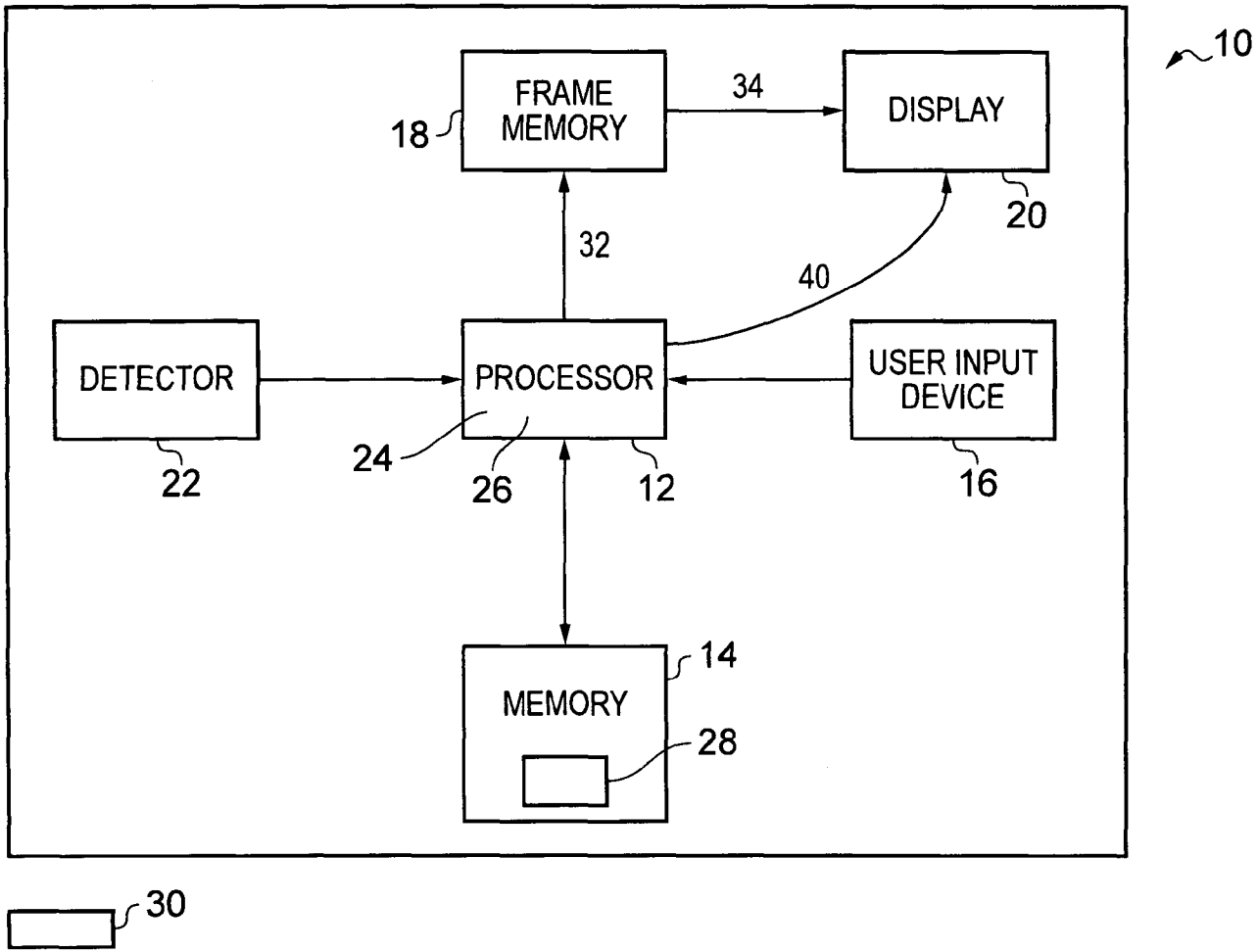
FIG. 1 illustrates a schematic diagram of an apparatus according to various embodiments of the invention.
Figure 5:
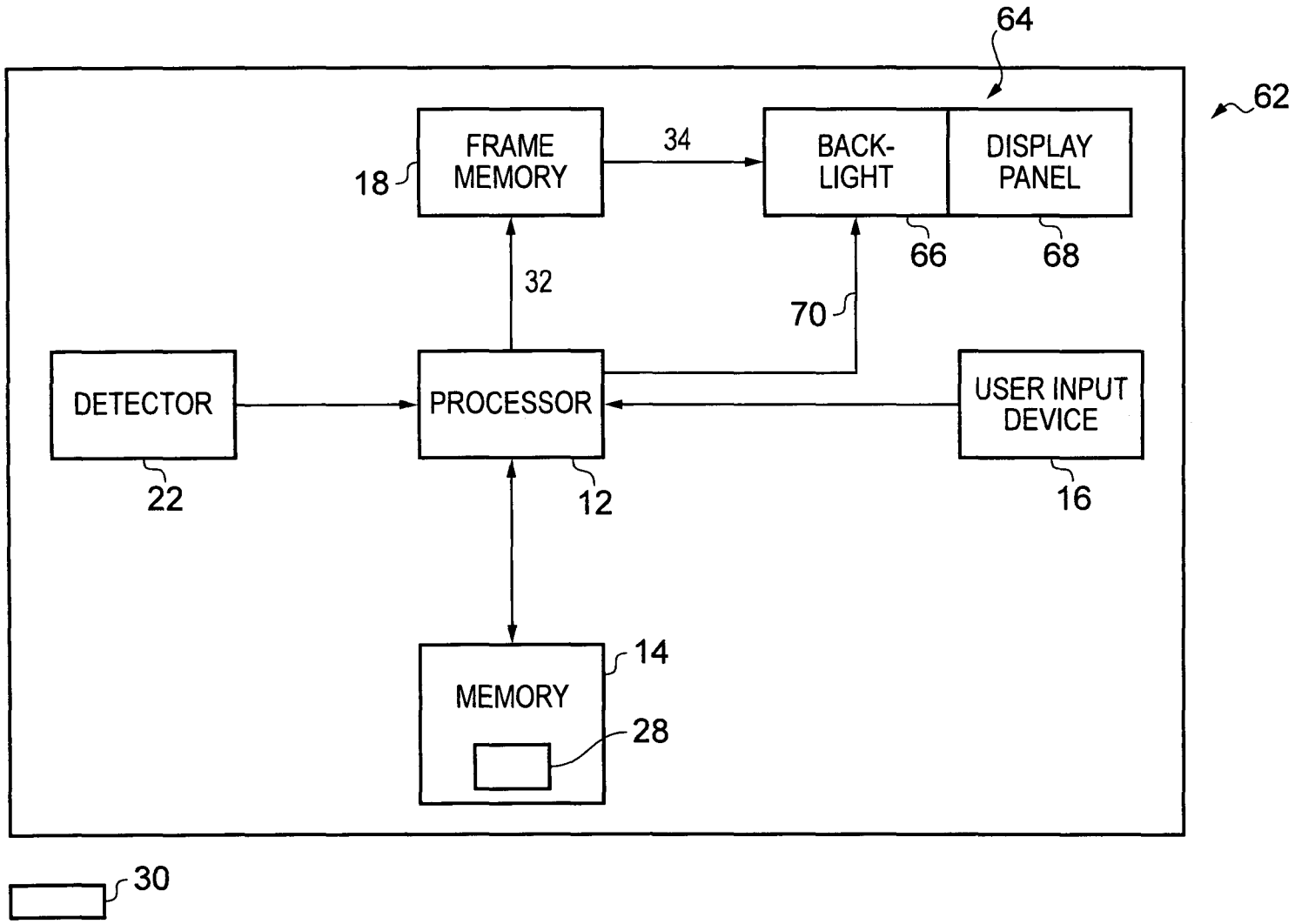
FIG. 5 illustrates a schematic diagram of another apparatus according to various embodiments of the invention.

FIGS. 1 and 5 illustrate an apparatus 10, 62 comprising: at least one processor 12; and at least one memory 14 including computer program code 28; the at least one memory 14 and the computer program code 28 configured to, with the at least one processor 12, cause the apparatus 10 at least to perform: selecting a luminance setting for at least a portion of a display 20 from a plurality of luminance settings; controlling the insertion of blank fields with respect to frames of data displayed on the display 20 for the selected luminance setting at a duty ratio, at least some of the luminance settings having an associated range of duty ratios.

In more detail, FIG. 1 illustrates an apparatus 10 that includes a processor 12, a memory 14, a user input device 16, a frame memory 18, a display 20 and a detector 22. The apparatus 10 may be a portable electronic device such as a mobile cellular telephone, laptop computer, a netbook computer, tablet computer, a wearable computer, personal digital assistant (PDA) or a portable music player for example. The apparatus 10 may be a non-portable electronic device such as a television for example. The apparatus 10 may be a display module for the above devices or other devices. As used here, 'module' refers to a unit or apparatus that excludes certain parts/components that would be added by an end manufacturer or a user. For example, where the apparatus 10 is a display module, the apparatus 10 may not include the user input device 16.

The processor 12 may include any suitable circuitry and may be a microprocessor for example. The implementation of the processor 12 can be in hardware alone (for example, a circuit, a controller and so on), have certain aspects in software including firmware alone or can be a combination of hardware and software (including firmware).

The processor 12 may be implemented using instructions that enable hardware functionality, for example, by using executable computer program instructions in a general-purpose or special-purpose processor that may be stored on a computer readable storage medium (for example, a disk, a memory and so on) to be executed by such a processor.

The processor 12 is configured to read from and write to the memory 14. The processor 12 may also comprise an output interface 24 via which data and/or commands are output by the processor 12 and an input interface 26 via which data and/or commands are input to the processor 12.

The memory 14 may be any suitable memory and may, for example be permanent built-in memory such as flash memory or it may be a removable memory such as a hard disk, secure digital (SD) card or a micro-drive. The memory 14 stores a computer program 28 comprising computer program instructions that control the operation of the apparatus 10 when loaded into the processor 12. The computer program instructions 28 provide the logic and routines that enables the apparatus 10 to perform the method illustrated in FIG. 4 and described in the following paragraphs. The processor 12 by reading the memory 14 is able to load and execute the computer program 28.

The apparatus 10 therefore comprises: at least one processor 12; and at least one memory 14 including computer program code 28, the at least one memory 14 and the computer program code 28 configured to, with the at least one processor 12, cause the apparatus 10 at least to perform: selecting a luminance setting for at least a portion of a display 20 from a plurality of luminance settings; controlling the insertion of blank fields with respect to frames of data displayed on the display 20 for the selected luminance setting at a selected duty ratio, at least some of the luminance settings having an associated range of duty ratios.

The computer program 28 may arrive at the apparatus 10 via any suitable delivery mechanism 30. The delivery mechanism 30 may be, for example, a computer-readable storage medium, a computer program product, a memory device, a record medium such as a Blu-Ray disc, a compact disc read-only memory (CD-ROM) or a digital versatile disc (DVD), or an article of manufacture that tangibly embodies the computer program 28. The delivery mechanism 30 may be a signal configured to reliably transfer the computer program 28. The apparatus 10 may propagate or transmit the computer program 28 as a computer data signal. The computer program 28 may also arrive at the apparatus 10 via a wired or wireless connection from a server (for example, via a universal serial bus (USB) connector or via a third generation (3G) wireless network).

Although the memory 14 is illustrated as a single component it may be implemented as one or more separate components some or all of which may be integrated/removable and/or may provide permanent/semi-permanent/dynamic/cached storage.

References to 'computer-readable storage medium', 'computer program product', 'tangibly embodied computer program' etc. or a 'controller', 'computer', 'processor' and so on should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other processing circuitry. References to computer program, instructions, code and so on should be understood to encompass software for a programmable processor or firmware such as, for example, the programmable content of a hardware device whether instructions for a processor, or configuration settings for a fixed-function device, gate array or programmable logic device and so on.

As used in this application, the term 'circuitry' refers to all of the following:

(a) hardware-only circuit implementations (such as implementations in only analog and/or digital circuitry) and (b) to combinations of circuits and software (and/or firmware), such as (as applicable): (i) to a combination of processors or (ii) to portions of one or more processors/software (including one or more digital signal processors), software, and memory(ies) that work together to cause an apparatus, such as a mobile phone or server, to perform various functions) and (c) to circuits, such as a one or more microprocessors or a portion of one or more microprocessors, that require software or firmware for operation, even if the software or firmware is not physically present. This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in server, a cellular network device, or other network device.

The user input device 16 may be any device that may be manipulated by a user of the apparatus 10 and provide control signals to the processor 12. The user input device may include a keypad, a keyboard, a computer mouse, one or more buttons, a joystick or a touch pad. In various embodiments, the user input device 16 may be integrated into the display 20 and together form a touch screen display.

Figure 2:
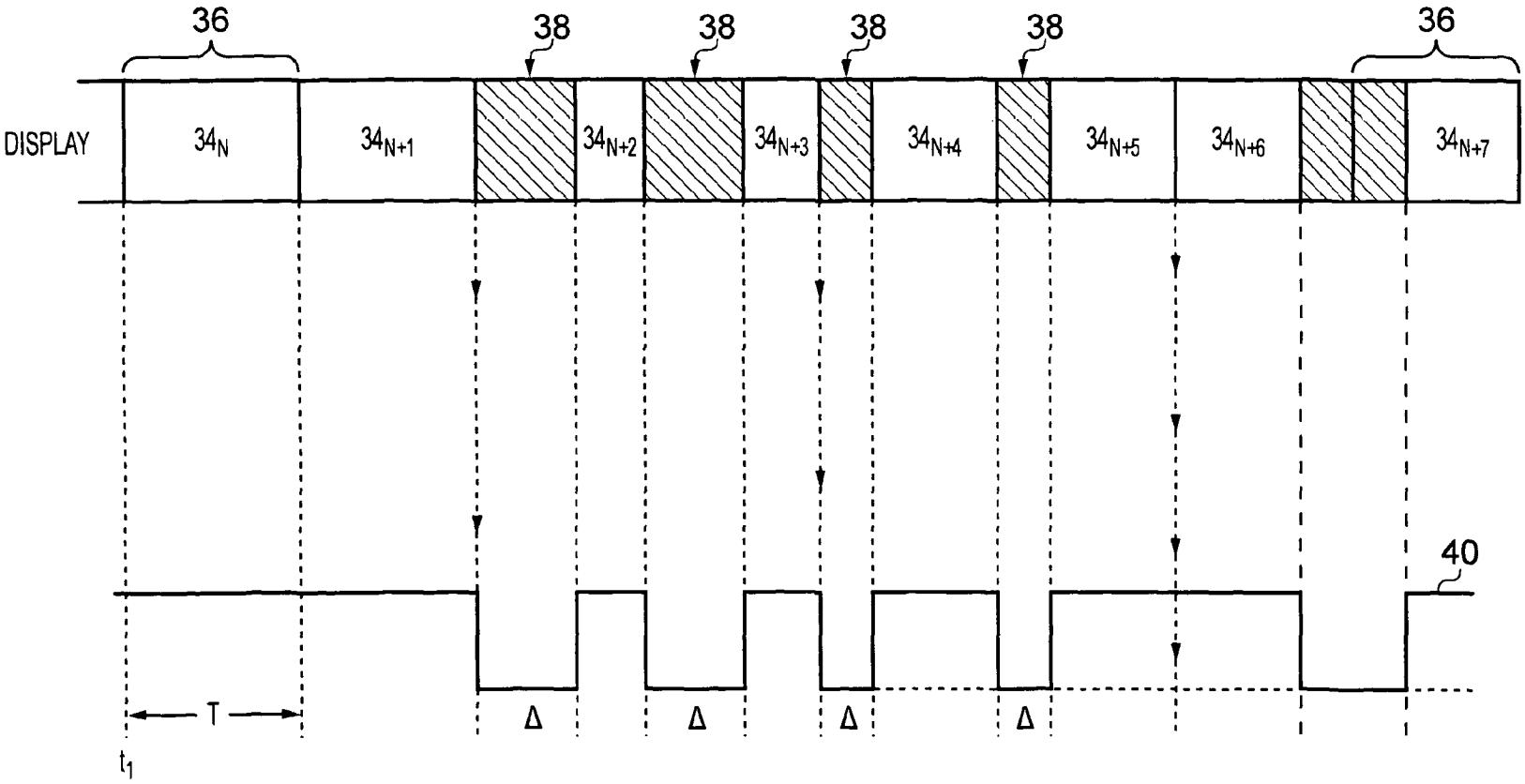
FIG. 2 illustrates a schematic timing diagram for the apparatus illustrated in FIG. 1.

Referring to FIGS. 1 and 2, the processor 12 has an interface to the frame memory 18 over which successive frames of data 32 are sent to fill the frame memory 18. In the illustrated example, the frames of data 32 are sent periodically every time period T. The frames of data 32 may be sent asynchronously and without flow control.

The frame memory 18 has an interface to the display 20 over which the successive frames of data 34 stored in the frame memory 18 are loaded to the display 20 and are displayed as display frames 36 with a periodicity of T. The frame of data 34 loaded to the display 20 may be the same as the frame of data 32 previously sent by the processor 12 to fill the frame memory 18.

The frame memory 18 may operate as a first-in-first-out register. It may only have storage capacity for one frame of data. Alternatively it may have storage capacity for more than one frame of data. In some embodiments, the apparatus 10 may not include the frame memory 18 and instead, the frame of data 32 is sent directly to the display 20. In other embodiments, the frame memory 18 may be part of the memory 14 and frames of data are sent to the display without a separate frame buffer. In still other embodiments, the frame memory 18 may be part of the display 20.

The display 20 may, in some embodiments be a high output luminance display. The display 20 may be, for example, an active matrix (AM) organic light emitting diode (OLED) display or a thin film transistor (TFT) liquid crystal display (LCD). The display 20 may have high contrast and high resolution.

The display 20 may operate with a display frame rate of 60 Hz or 75 Hz, for example. This is three times the Phase Alternate Line (PAL) rate, 2.5 times the National Television System Committee (NTSC) rate and approximately three times a film frame rate.

The display 20 has a plurality (that is, two or more) of different luminance settings that determine the maximum luminance output from the display 20.

In one embodiment, the plurality of luminance settings is a plurality of gamma values that are applied to the frames of data 32 or 34. For example, the plurality of gamma values could include 1.0, 1.2, 1.4, 1.6, 1.8, 2.0, 2.2 and so on. In another embodiment, the plurality of luminance settings is a plurality of brightness settings that linearly increase/decrease the brightness of the display 20. For example, the brightness settings may be 1, 2, 3, 4 and so on, and the display 20 luminance is defined by these brightness settings. It should be appreciated that the human eye luminance perception is non-linear and that the change in luminance output from the display 20 may be linear or non-linear. The luminance setting of the display may be selected by a user of the apparatus 10 and/or by the apparatus 10 itself.

The processor 12 may be configured to insert blank fields (images) 38 within the display frames 36 using control signal 40. As described in greater detail in the following paragraphs, a blank field 38 may be a black sub frame (for example, black image data or implemented by turning off display 20 light emission). A blank field 38 may also be a dimmed image (for example, modified image data or display 20 luminance may be dimmed). This process may be referred to as an 'impulse drive' mode. Where the apparatus 10 is a display module, the processor 12 may be a timing controller within the display 20 that is configured to insert blank fields 38 within the display frames 36. Consequently, the control signal 40 may be internal to the display 20 and may not require a connection to a processor of the device hosting the display module.

The blank fields may in some embodiments be blank (sub) frames 38 within the display frame 36 and between (sub) frames of data 34. A display frame 36 of duration T can therefore be shared between a blank (sub) frame 38 of duration Δ and a (sub) frame of data 34 of duration T−Δ. The blank fields 38 in this example last Δ and start at time t1+mT where m is an integer and where Δ is a parameter controlled by the processor 12. In this example, the display frame 34 is time divided between the wholly blank (sub) frame 38 and the data (sub) frame 34.

In other embodiments, the blank field 38 and the data frame 34 co-exist with the blank field overlying a portion of the display frame 36 with the other portion of the display frame 36 being occupied by one or more data frames.

The blank field 38 progressively scans across the display frame 36 as display refresh (scanning) proceeds. The blank field may be positioned at the interface between the tail end of a leading frame of data and a leading end of a following frame of data. As the following frame of data progresses across the display towards an edge of the display, the blank field 38 in advance of it reduces in size and another blank field following it increases in size. This is usually referred to as 'scanning backlight' and 'scanning emission' in the art and is illustrated in FIG. 2 for data frames $\mathbf{34}_{N+6}$ and $\mathbf{34}_{N+7}$.

A blank field 38 may be a field that contains no data so that the frame or frame portion appears black or contains adapted data such that the frame or frame portion appears a different monotone color or appears dimmed, for example.

The duration of a blank field 38 as a proportion of the duration of a display frame 36 may be referred to as the 'duty ratio' or the 'duty cycle'. The duty ratio is greater when the duration of a blank field 38 as a proportion of the duration of a display frame 36 is lower. Similarly, the duty ratio is lower when the duration of a blank field 38 as a proportion of the duration of a display frame 36 is higher. Consequently, a duty ratio of 100% corresponds to where a blank field 38 is not inserted into a display frame 36. A duty ratio of 0% corresponds to where the duration of a blank field 38 is equal to the duration of a display frame 36. A duty ratio of 50% corresponds to where the duration of a blank field 38 is equal to half the duration of a display frame 36. The duty ratio/cycle affects the screen luminance. A higher duty ratio provides a brighter display whereas a lower duty ratio provides a dimmer display. A duty ratio of 100% produces maximum brightness for a luminance setting of the display 20.

The detector 22 may be any suitable detector, or combination of detectors, for detecting one or more contexts. For example, the detector 22 may include an ambient light sensor (ALS) for detecting the total luminance flux incident on a surface of the apparatus 10 (that is, the illuminance). By way of another example, the detector 22 may be configured to determine the rate at which frames of data 32 are sent to the frame memory 18, and/or the rate at which frames of data 34 are sent to the display 20 from the frame memory 18. The detector 22 may be implemented by the processor 12 or may be a separate device (such as an electronic component or item of software).

Consequently, the detected context may, in one example embodiment be that the content (for example, text, graphics, photographs and so on) represented by successive data frames 32, 34 loaded into the display 20 comprises fast moving content (a fast moving image for example). The fast moving content may, for example, result from the display of video or as a consequence of a user scrolling or moving content on the display 20. In this embodiment, the detector 22 may detect the content type represented by the data frames 32, 34. Fast moving content may cover only part of the screen area of the display 20 and the detector 22 may analyze the content (in successive data frames 32, 34) to determine the moving content speed or the speed of a moving object within the content (for example, an animation). As described in more detail in the following paragraphs, the determination of moving content speed may be used for determining control parameters for the display 20 for optimal viewing (optimized duty and luminance settings for this moving content case to minimize perceived blur and flicker).

The speed of moving content may also be determined by analyzing the rate at which frames of data 32 are sent to the frame memory 18, where a high rate indicates that content is moving at high speed and a low rate indicates that content is moving at low speed. A frame rate of 60 Hz is typically used to produce smooth content movement on the display 20. The human eye is however quite sensitive to flicker at this frame rate if impulse drive with low duty is used. Since flicker and blur are reduced when using a higher content frame rate (and display frame rate), the apparatus 10 may increase the content update rate depending on the content displayed. For example, a higher frame rate such as 75 Hz may be used when moving content is shown on the display 20. This embodiment provides an advantage in that power consumption is reduced since a higher frame rate (which causes additional power consumption) may only be used when needed (that is, when moving content is displayed).

The detected context may, alternatively or additionally, be an external or environmental or ambient context that is dependent upon the surrounding, external environment to the apparatus 10 at that time. For example, the context may be ambient light conditions such as ambient illuminance. In some implementations, the ambient light sensor 22 may be integrated as part of the display 20.

At least some of the plurality of luminance settings of the display 20 have an associated range of duty ratios. The ranges of duty ratios are optimized for improving the quality of the display output 20. In particular, the ranges are optimized to reduce blurring and flickering of a moving output.

The luminance of the display 20 varies with duty ratio (that is, the higher the duty ratio, the higher the luminance of the display 20 and, the lower the duty ratio, the lower the luminance of the display 20). Consequently, a luminance setting and associated range of duty ratios form a band, where the luminance setting defines the maximum luminance of the band and the selected duty ratio determines the selected luminance within the band.

The ranges of duty ratios may be predetermined to minimize blur and flicker perceived by a user of the apparatus 10. Consequently, a duty ratio may be selected from the ranges of duty ratios. For example, a manufacturer may perform a series of tests to determine optimum ranges of duty ratios that minimize perceived blur and flicker on the display 20. These tests may be carried out by a person on a subjective basis or may be carried out by a device that monitors blur and flicker levels. Since flicker and blur are also reduced when using a higher content frame rate (and display frame rate), the apparatus 10 may be configured to increase the content update rate depending on the content displayed.

Usually, perceived flicker increases as the duty ratio decreases and decreases as the duty ratio increases. Additionally, perceived blur usually increases as the duty ratio increases and usually decreases as the duty ratio decreases. Consequently, it should be appreciated that the ranges may be predetermined so that the upper limit minimizes perceived flicker, but does not cause substantial blurring and so that the lower limit minimizes blurring, but does not cause substantial perceived flickering.

Additionally or alternatively, the associated ranges of duty ratios may be changed in dependence upon one or more detected contexts to minimize flicker perceived by the user. The associated ranges of duty ratios may be changed in real-time (that is, in response to a change in the detected context) or may be changed periodically (that is, the ranges of duty ratios are updated periodically if there has been a change in the detected context).

Additionally, the luminance settings (that is, the band lower and upper limits) may be changed in real-time (dynamically) or periodically to maintain the display 20 luminance according to a profile used (profiles are explained in greater detail in the following paragraphs). Since changes in duty ratio range may change the luminance of the display 20, the luminance settings may be changed to compensate and meet the luminance level desired.

It has been observed that perceived flicker is dependent upon the movement of content on the display 20. Where the movement of content on the display 20 is high/fast, the user typically perceives less flicker on the display 20 for a given duty ratio, and where the movement of content on the display 20 is low/slow or where the content is stationary (that is, no movement), the user perceives more flicker on the display 20 for a given duty ratio. The ranges of duty ratios may be changed by changing the lower limit and/or the upper limit. As mentioned in the preceding paragraph, in order to keep the luminance of the display 20 relatively constant, the luminance settings may be adjusted as well to compensate.

By way of example, if the detector 22 detects that the movement of content on the display 20 is high, the lower limit of one or more ranges of duty ratios may be lowered (for example, the lower limit may be lowered from 50% to 40%) to reduce blurring since the relatively higher content movement reduces the user's perceived flicker. Similarly, if the detector 22 detects that the movement of content on the display 20 is low, the lower limit of one or more ranges of duty ratios may be increased (for example, from 50% to 60%) to reduce perceived flicker since the relatively low content movement increases the user's perceived flicker. Furthermore, the upper limit of one or more of the ranges may be increased (for example, from 75% to 85%), since perceived flicker is increased by low content movement.

It has also been observed that perceived flicker is dependent upon the contrast changes across the display 20, that is, how contrast is distributed within the content frames being displayed. For example, a display showing content having a mixture of text, graphics and/or images filling at least a portion or the whole of the display 20 area with different luminance and color (typically the case with internet content) may have significant contrast changes across the display 20 area (that is, high contrast distribution). Where there are large areas with gradually changing bright content (a bright sky or snow for example), the contrast changes across the display 20 area may be relatively low (that is, relatively low contrast distribution). Where the display 20 displays moving content with significant contrast changes, the contrast distribution may be relatively high.

Where the contrast distribution on the display 20 is high, the user perceives less flicker on the display 20 for a given duty ratio, and where the contrast distribution on the display 20 is low, the user perceives more flicker on the display 20 for a given duty ratio. Consequently, if the detector 22 detects that the contrast distribution on the display 20 is high (for example, above a first threshold), the lower and/or upper limit of one or more ranges of duty ratios may be lowered since the relatively high contrast distribution reduces the user's perceived flicker. Similarly, if the detector 22 detects that the contrast distribution on the display 20 is low (for example, below a second threshold), the lower and/or upper limit of one or more ranges of duty ratios may be increased to reduce perceived flicker since the relatively low contrast distribution increases the user's perceived flicker.

The processor 12 may use content adaptive brightness control (C-ABC) to control the luminance of the display 20. In more detail, the processor 12 may analyze content luminance distribution (for example, via an image histogram) and adjust (for example, dynamically) image frame data 34 luminance (that is, the content data histogram is widened). Where the display 20 is a liquid crystal display, luminance of a backlight of the display 20 may be adjusted (for example, dynamically) for each frame to advantageously lower the display 20 power consumption. When using C-ABC with embodiments of the present invention, the frame data 34 is analyzed & modified and backlight luminance may be lowered by impulse (duty) drive.

Light emitting diodes (LED) and organic light emitting diodes (OLED) are emissive technology and it should be appreciated that power consumption is lower when darker content is shown. With liquid crystal displays, the LCD functions as a shutter and usually the backlight is on all the time. Backlight luminance may be controlled by adjusting the backlight current (for example, an LED backlight current) or by using pulse width modulation (PWM). With C-ABC (which may also be called dynamic backlight (BL) control), the backlight luminance is modulated depending on the content shown and this way power consumption may also be reduced. Dynamic backlight control may also improve the contrast of the display 20 (also called dynamic contrast).

With active matrix organic light emitting diode displays, impulse drive can be implemented and also be based on the content shown on the display 20. The frame image histogram may be stretched (as described above) and at the same time duty and/or luminance setting is selected so that display luminance is maintained. Each frame may appear to the user the same as in conventional displays (same luminance), however moving content/image performance is improved by using impulse drive.

Figure 3:
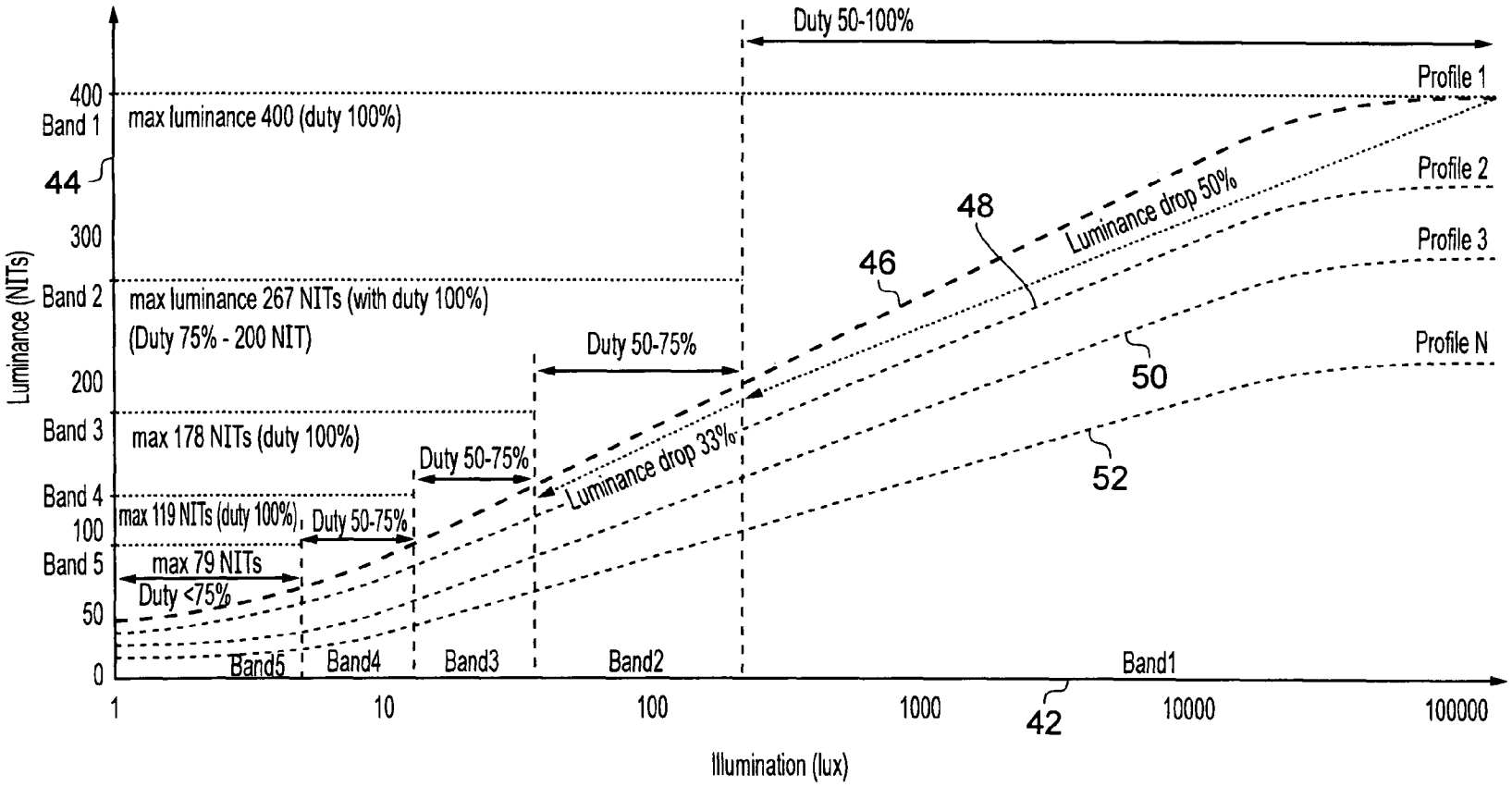
FIG. 3 illustrates a graph of illuminance against display luminance for the apparatus illustrated in FIG. 1.

FIG. 3 illustrates an exemplary graph of detected illuminance against display luminance for the apparatus 10 illustrated in FIG. 1. In more detail, the graph includes a horizontal axis 42 for illumination detected by the apparatus 10 (for example, as measured by the ambient light sensor 22) and having units of lux. The graph also includes a vertical axis 44 for the luminance of the display 20 and having units of Nits (candela per square meter). It should be appreciated that the data forming the graph may be stored in the memory 14 and may be used by the processor 12 when performing the method illustrated in FIG. 4.

In this example, the apparatus 10 has five luminance settings. Where the duty of the impulse drive is 100% (that is, no blank fields 38 are inserted into the display frames 36), the luminance settings define the maximum brightness of the display 20. The luminance of the first luminance setting is 400 Nits, the luminance of the second luminance setting is 267 Nits, the luminance of the third luminance setting is 178 Nits, the luminance of the fourth luminance setting is 119 Nits and the luminance of the fifth luminance setting is 79 Nits.

The first, second, third, fourth and fifth luminance settings have an associated range of duty ratios. As described in greater detail below, in some embodiments the ranges of duty ratios and luminance settings are predefined and in other embodiments, they are programmable by the apparatus 10 and may vary over time. The first luminance setting has an associated duty ratio range of 50% to 100% which forms a first band for illuminances between 400 lux and 100000 lux. The second luminance setting has an associated duty ratio range of 50% to 75% which forms a second band for illuminances between 60 lux and 400 lux. The third luminance setting has an associated duty ratio range of 50% to 75% which forms a third band for illuminances between 20 lux and 60 lux. The fourth luminance setting has an associated duty ratio range of 50% to 75% which forms a fourth band for illuminances between 7 lux and 20 lux. The fifth luminance setting has an associated duty ratio range of less than 75% which forms a fifth band for illuminances between 1 lux and 7 lux.

The variation in the luminance of the display 20 (controlled by changing the luminance setting and the duty ratio) with detected illuminance is represented by a dark first dotted line 46. The first line 46 commences at an illumination of 1 lux and a luminance of 45 Nits and has a gradient of zero. As the illumination increases, the gradient of the first line 46 gently increases until an illumination of 15 lux and a luminance of 80 Nits. The gradient of the first line 46 is then substantially constant until an illumination of 30000 lux and 380 Nits. As the illumination increases from 30000 lux, the gradient of the first line 46 decreases until the gradient is substantially zero at an illumination of 80000 lux and luminance of 400 Nits.

FIG. 3 also illustrates a second dotted line 48, a third dotted line 40 to an Nth dotted line 52 (where N can be any integer) that have a similar shape to the first dotted line 46. The first dotted line 46, the second dotted line 48, the third dotted line 50 to the Nth dotted line 52 represent the variation of the luminance of the display 20 with detected illuminance for different apparatus 10 profiles or modes. The second dotted line 48 is positioned below the first dotted line 46 in the vertical axis, the third dotted line 50 is positioned below the second dotted line 48 in the vertical axis and the Nth dotted line 52 is positioned below the third dotted line 50 in the vertical axis.

The profiles may be user selectable so that the user may select an appropriate profile for the environment he is in, for the content he wants to view (for example, viewing motion video), or for controlling power consumption (that is, operating time of the apparatus 10) and so on. Consequently, the apparatus 10 may have more than one profile for different purposes where at least some of the profiles have an input to the impulse drive control. For example, in car use, a user may want a very dim display in dark conditions (to avoid being blinded while driving) and very high luminance in bright conditions (for navigation in daylight for example). By way of an example, the first dotted line 46 may be for an outdoor profile and has a range of relatively high luminances so that a user may view content on the display 20 outdoors. The second dotted line 48 may be for an indoor profile that has a range of lower luminances so that a user may view content on the display 20 comfortably indoors. The third dotted line 50 may be for an energy saving profile that has a range of relatively low luminances to reduce the electrical energy consumption of the display 20.

The operation of the apparatus 10 will now be described with reference to FIG. 4.

At block 54, the method includes selecting a luminance setting for at least a portion of the display 20 from the plurality of luminance settings. The luminance setting may be selected according to the profile of the apparatus. The processor 12 may receive a signal from the detector 22 indicating the detected illumination. Where the apparatus 10 is a display module, the processor 12 may be integrated logic within the display module working autonomously under supervision of a processor of the host device. The processor 12 then uses the detected illuminance to determine which band and hence which luminance setting to select. For example (and with reference to FIG. 3), if the detector 22 detects an illuminance of 100 lux, the processor 12 selects band 2 and the second luminance setting (267 Nits). If the detector 22 detects an illuminance of 14 lux, the processor 12 selects the fourth band the fourth luminance setting (119 Nits).

Additionally or alternatively, a user of the apparatus 10 may select a luminance setting by manipulating the user input device 16 and selecting a luminance setting (which may be displayed for selection on the display 20). In this instance, the processor 12 receives the control signal from the user input device 12 and controls the display 20 to have the user selected luminance setting. The user may select a fixed display 20 luminance setting or choose a luminance profile, in which case, the detector 22 (for example, an illuminance sensor) output may be used to change the display 20 luminance based on the profile selected. A fixed luminance value may be achieved by choosing an appropriate luminance setting (band) and duty ratio.

Additionally or alternatively, the luminance setting of the display 20 may be selected using content adaptive brightness control (C-ABC) as described in the preceding paragraphs.

At block 56, the method includes determining/selecting a duty ratio from the range of duty ratios associated with the selected luminance setting in dependence upon one or more contexts. The processor 12 may use an algorithm that calculates a duty ratio using the detected context. For example, where the luminance setting selected in 54 is the second luminance setting and the detected illumination is 100 lux, the processor 12 calculates that the corresponding duty ratio is 65% and then uses that duty ratio to obtain a desired 170 NIT ($cd/m^2$) display luminance. Where the calculated duty ratio is outside of the duty ratio range, the processor 12 may select the closest duty ratio within the range.

Additionally or alternatively, the processor 12 may determine the amount of content (for example, text, graphics, photographs and so on) movement in the data sent to the display 20 and select a suitable duty ratio from the range accordingly. For example, the processor 12 may determine that content movement is low and consequently select a relatively high duty ratio (for example, 75%) to reduce the flicker perceived by the user. The processor 12 may determine that content movement is high and consequently select a relatively low duty ratio (for example 55%) to reduce image blur. The duty ratio may also be selected by determining the contrast distribution of content being sent to the display 20.

If the processor 12 determines that the data sent to the display 20 does not include any moving content, the processor 12 may then select a duty ratio of 100% and may consequently not use the 'impulse drive' mode. Instead, a 'sample and hold' display drive method may be used or if impulse drive mode is used, duty frequency may be increased to a higher level to avoid perceived flicker (for example, 2× or some other multiple frame rate).

At block 58, the method includes controlling the insertion of blank fields 38 with respect to frames of data 36 displayed on the display 20 for the luminance setting calculated and selected in block 54 at the duty ratio determined/selected in block 56.

At block 60, the method includes changing the range of one or more ranges of the duty ratios in dependence upon one or more detected contexts as described above. The processor 12 may change the duty ratio range of the currently selected band only. In other embodiments, the processor 12 may change the duty ratio range of some or all of the bands in some or all of the apparatus 10 profiles. Block 60 may also include changing one or more luminance settings (which define the maximum brightness of a band) in dependence upon one or more detected contexts (that is, the luminance settings may be dynamic and be based upon the detected context). For example, the processor 12 may determine a change in the content frame rate, a change in content movement and/or a change in the content itself (for example, a change in the contrast distribution of the content) and change the luminance settings accordingly. It should be appreciated that block 60 may be performed at any time and need not be performed after block 58. Furthermore, it should be appreciated that the ranges of duty ratios and the luminance settings may be changed at the same time or at different times.

Embodiments of the present invention may provide an apparatus 10 with a display that has a relatively large number of possible luminances. By providing at least some of the luminance settings with a range of duty ratios, the apparatus 10 may be able to smoothly vary the luminance of the display 10 in dependence upon a detected context (detected illumination for example). This may be particularly advantageous in devices which include an organic light emitting diode (OLED) display which may have only eight luminance (gamma) settings.

Embodiments of the present invention may also improve the moving content quality of the display 20 since the ranges of duty ratios are either predetermined or dynamically controlled to minimize perceived blur and flicker on the display 20. This may improve the user's enjoyment of the apparatus 10 and the applications running on the apparatus 10.

Embodiments of the present invention also provide an advantage where the apparatus 10 includes an Automatic Current Limit function (ACL). Automatic Current Limit function is configured to limit peak current supplied to the display 20 where the frame data 32, 34 has too many pixels on. Usually, use of the Automatic Current Limit function reduces the display 20 to a single luminance setting. Embodiments of the present invention may enable a larger number of display luminances since the luminance of the display 20 may be varied by varying the duty ratio and/or by selecting another band with a lower luminance setting.

Embodiments of the present invention may provide an advantage when used in conjunction with a low power mode of the display 20. In such a low power mode, the display 20 power consumption may be lowered by turning off parts of the logic when they are not needed. For example, when the apparatus 10 is in idle mode (no activity ongoing), some or all unnecessary logic may be turned off to conserve power including the display 20. For example, the display 20 may show only a limited number of colors and/or have a reduced luminance and/or only a portion of display area may be used, and so on.

Typically, in low power mode the display 20 luminance is limited to only one or a limited number of luminance settings. Where embodiments of invention are used in conjunction with a low power mode, the display 20 luminance can be flexibly adjusted and may be based on a detected context such as the illuminance in the room. This may be helpful (for example) in a dark bedroom where the user is sleeping, the display luminance may be dimmed to cause less irritation to the user and further lower power consumption.

FIG. 5 illustrates a schematic diagram of another apparatus 62 according to various embodiments of the invention. The apparatus 62 is similar to the apparatus 10 illustrated in FIG. 1 and where the features are similar, the same reference numerals are used.

The apparatus 62 differs from the apparatus 10 in that the apparatus 62 includes a display 64 which comprises a backlight 66 and a display panel 68. The display 64 may be a liquid crystal display (LCD). The processor 12 uses a control signal 70 to control lighting for the display 64. Where the apparatus 10 is a display module, the control signal 70 may be integrated within the display module and may not be provided by a processor of a host device. In this illustrated example, the control signal 70 switches the lighting 66 on and off, but in other implementations it may dim the lighting instead of turning it off. Dimming would, however, typically involve a step-change in luminance. The blank field 38 is therefore a black or dark frame in which any data loaded into the display 64 is not visible or dimmer.

In some cases the display frame can be formed from two successive images, one brighter another darker to make the overall image look correct without losses in screen luminance. The control of the lighting of the display 64 may be achieved by controlling the backlight 66, if present, or, if a backlight is not present, by adapting the frame data 34. If a backlight is present, it may be an integral part of the display 68.

In this example, the control signal 70 switches the backlighting 66 on and off. The processor 12 is configured to control insertion of blank frames between frames of data 34 displayed on the display 64 by temporarily switching off the backlighting for the duration of the blank frame 38. A suitable control signal 70 is illustrated in FIG. 2. The example control signal 70 in FIG. 2, has a programmable duty ratio in which the backlighting 66 is off for Δ between time t1+mT and t1+Δ+mT and in which the backlighting 66 is on for T−Δ between time t1+Δ+mT and t1+T+mT, where m is an integer. In the illustrated example, t1 coincides with the beginning of a display frame 36 but t1 need not necessarily coincide with the beginning of a display frame 36 (for example, in the case of scanning backlight).

Embodiments of the present invention provide an advantage in that the computer program 28 may be substantially the same for apparatus 10 and for apparatus 62. In other words, the computer program 28 may be used/compatible for controlling a light emitting diode (LED) display, an organic light emitting diode (OLED) display and a liquid crystal display (LCD).

Figure 4:
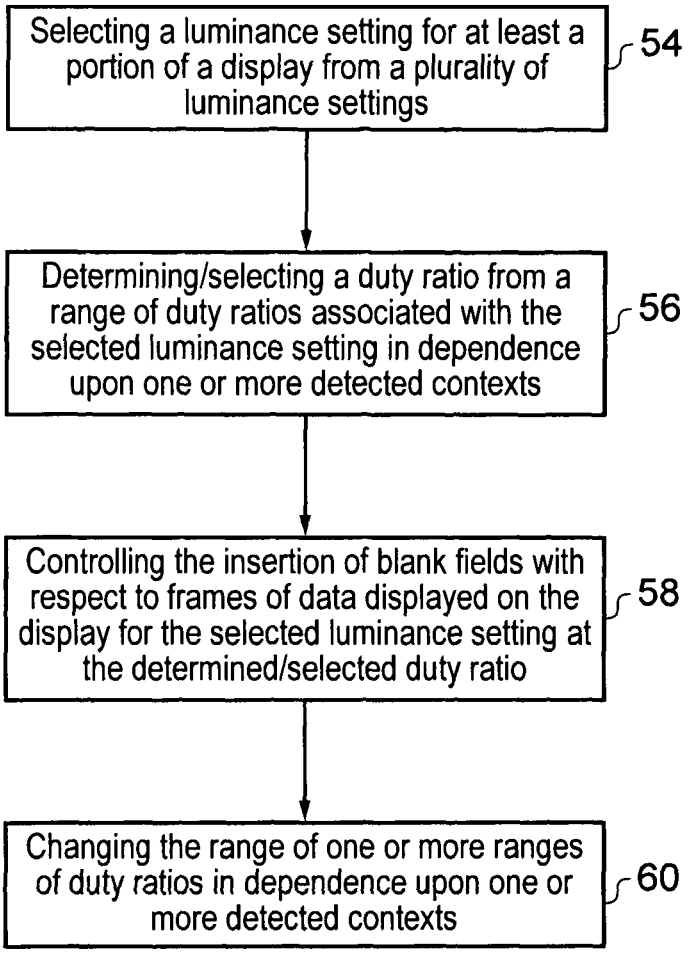
FIG. 4 illustrates a flow diagram of a method according to various embodiments of the invention.

The blocks illustrated in the FIG. 4 may represent steps in a method and/or sections of code in the computer program 28. The illustration of a particular order to the blocks does not necessarily imply that there is a required or preferred order for the blocks and the order and arrangement of the block may be varied. Furthermore, it may be possible for some blocks to be omitted.

Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A method comprising:

selecting a luminance setting for at least a portion of a display from a plurality of luminance settings;

providing a range of duty ratios at the selected luminance setting; and controlling the insertion of blank fields with respect to frames of data displayed on the display for the selected luminance setting at a duty ratio, at least some of the luminance settings having an associated range of duty ratios for reducing flicker and/or blur perceived by a user.

2. A method as claimed in claim 1, further comprising automatically changing at least some of the luminance settings in value in dependence upon one or more detected contexts.

3. A method as claimed in claim 1, further comprising changing the range of one or more ranges of duty ratios in dependence upon one or more detected contexts to minimize flicker and/or blur perceived by a user wherein the one or more detected contexts includes detected movement of content displayed on the display.

4. A method as claimed in claim 1, further comprising selecting a duty ratio from the range of duty ratios associated with the selected luminance setting in dependence upon one or more detected contexts.

5. A method as claimed in claim 4, wherein the one or more detected contexts includes detected illuminance and/or detected movement of content displayed on the display.

6. A method as claimed in claim 1, further comprising determining whether the display content is updated, wherein if the display content is updated the method includes entering an impulse drive mode, and if the display content is not updated the method includes entering the impulse drive mode and controlling the insertion of blank fields with respect to frames of data at a higher frequency than if display content is updated, or not entering impulse drive mode.

7. A method as claimed in claim 1, further comprising selecting a different luminance setting, having an associated range of duty ratios, for at least a portion of the display in dependence upon one or more detected contexts and/or in dependence upon displayed content.

8. A method as claimed in claim 1, further comprising performing content adaptive brightness control (C-ABC) to modify content frame image data of one or more frames of data and wherein the luminance setting and duty ratio are selected to maintain a display luminance.

9. A method as claimed in claim 1, further comprising dynamically changing display frame rate in dependence upon the content in the frames of data to minimize perceived flicker.

10. A method as claimed in claim 1, further comprising providing a plurality of profiles, wherein at least some of the plurality of profiles have a plurality of luminance settings and associated ranges of duty ratios.

11. A method as claimed in claim 1, wherein the display is an active matrix organic light emitting diode (AM OLED) display having a predefined number of luminance settings.

12. An apparatus comprising:

at least one processor; and at least one memory including computer program code; the at least one memory and the computer program code configured to, with the at least one processor, cause the apparatus at least to perform:

selecting a luminance setting for at least a portion of a display from a plurality of luminance settings;

providing a range of duty ratios at the selected luminance setting; and controlling the insertion of blank fields with respect to frames of data displayed on the display for the selected luminance setting at a duty ratio, at least some of the luminance settings having an associated range of duty ratios for reducing flicker and/or blur perceived by a user.

13. An apparatus as claimed in claim 12, wherein the at least one memory and the computer program code are configured to, with the at least one processor, cause the apparatus at least to perform: automatically changing at least some of the luminance settings in value in dependence upon one or more detected contexts.

14. An apparatus as claimed in claim 12, wherein the at least one memory and the computer program code are configured to, with the at least one processor, cause the apparatus to further perform: changing the range of one or more ranges of duty ratios in dependence upon one or more detected contexts to minimize flicker and/or blur perceived by a user wherein the one or more detected contexts includes detected movement of content displayed on the display.

15. An apparatus as claimed in claim 12, wherein the at least one memory and the computer program code are configured to, with the at least one processor, cause the apparatus to further perform: selecting a duty ratio from the range of duty ratios associated with the selected luminance setting in dependence upon one or more detected contexts.

16. An apparatus as claimed in claim 12, wherein the at least one memory and the computer program code are configured to, with the at least one processor, cause the apparatus at least to perform: determining whether the display content is updated, wherein if the display content is updated the method includes entering an impulse drive mode, and if the display content is not updated the method includes entering the impulse drive mode and controlling the insertion of blank fields with respect to frames of data at a higher frequency than if display content is updated, or not using impulse drive mode.

17. An apparatus as claimed in claim 12 comprised in a portable electronic device.

18. An apparatus as claimed in claim 12 comprised in a module.

19. A computer readable storage medium encoded with instructions that, when executed by a processor perform:

selecting a luminance setting for at least a portion of a display from a plurality of luminance settings;

providing a range of duty ratios at the selected luminance setting; and controlling the insertion of blank fields with respect to frames of data displayed on the display for the selected luminance setting at a duty ratio, at least some of the luminance settings having an associated range of duty ratios for reducing flicker and/or blur perceived by a user.

20. A computer readable storage medium as claimed in claim 19 encoded with instructions that, when executed by a processor perform:

automatically changing the range of one or more ranges of duty ratios in dependence upon one or more detected contexts to minimize flicker perceived by a user.

* * * * *